US006837695B2

(12) United States Patent
Une et al.

(10) Patent No.: US 6,837,695 B2
(45) Date of Patent: Jan. 4, 2005

(54) INLET PORT FOR A RECIPROCATING COMPRESSOR

(75) Inventors: Katsutaka Une, Saitama (JP); Juetsu Kurosawa, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 10 days.

(21) Appl. No.: 10/311,122

(22) PCT Filed: May 11, 2001

(86) PCT No.: PCT/JP01/03926

§ 371 (c)(1),
(2), (4) Date: Dec. 13, 2002

(87) PCT Pub. No.: WO01/98657

PCT Pub. Date: Dec. 27, 2001

(65) Prior Publication Data

US 2003/0091451 A1 May 15, 2003

(30) Foreign Application Priority Data

Jun. 20, 2000 (JP) ..... 2000-183911
Sep. 11, 2000 (JP) ..... 2000-274528

(51) Int. Cl.[7] ..... F04B 39/10; F04B 1/12; F16K 15/16

(52) U.S. Cl. ..... 417/571; 417/269; 417/569; 137/855

(58) Field of Search ..... 417/269, 507, 417/565, 569, 571; 137/512.4, 855

(56) References Cited

U.S. PATENT DOCUMENTS 3,241,748 A * 3/1966 Cramer et al. ..... 137/512.15
4,764,091 A 8/1988 Ikeda et al.
4,778,360 A * 10/1988 Ikeda et al. ..... 417/571
4,781,540 A * 11/1988 Ikeda et al. ..... 417/269
4,854,839 A * 8/1989 DiFlora ..... 417/571
5,173,040 A 12/1992 Yamazawa et al.
5,871,337 A * 2/1999 Fukanuma et al. ..... 417/222.2
5,885,064 A * 3/1999 McCoy ..... 417/569

FOREIGN PATENT DOCUMENTS

| | | |
|---|---|---|
| EP | 0 962 655 A2 | 12/1999 |
| GB | 2 161 583 A | 1/1986 |
| JP | 62-131985 A | 6/1987 |
| JP | 2000-54961 A | 2/2000 |

* cited by examiner

*Primary Examiner*—Justine R. Yu
*Assistant Examiner*—Timothy P. Solak
(74) *Attorney, Agent, or Firm*—Frishauf, Holtz, Goodman & Chick, P.C.

(57) ABSTRACT

A reciprocating refrigerant compressor includes a cylinder block having a cylinder bore, and a compression chamber defined within the cylinder bore. A cylinder head has a low-pressure chamber for receiving refrigerant gas to be drawn into the compression chamber, and is coupled to one end face of the cylinder block. A valve plate is arranged between the compression chamber and the low-pressure chamber, and includes an inlet port for guiding the refrigerant from the low-pressure chamber into the compression chamber. An inlet valve opens and closes the inlet port and has an end whose shape is adapted to a shape of the inlet port. The shape of the inlet port is non-circular, and a portion of an opening edge of the inlet port protrudes into the inlet port. Tangential lines drawn from the protruding portions intersect the opening edge of the inlet port at at least two points.

18 Claims, 8 Drawing Sheets

INLET PORT FOR A RECIPROCATING COMPRESSOR

This application is a U.S. National Phase Application under 35 USC 371 of International Application PCT/JP01/03926 filed May 11, 2001.

TECHNICAL FIELD

This invention relates to a reciprocating refrigerant compressor and more particularly to a reciprocating refrigerant compressor having a valve plate arranged between a cylinder block and a cylinder head.

BACKGROUND ART

Conventionally, a type of conventional reciprocating refrigerant compressor has been proposed which includes a cylinder block having a cylinder bore, a piston for linear reciprocating motion within the cylinder bore, a compression chamber defined within the cylinder bore, a cylinder head formed with a suction chamber into which refrigerant gas is received for being drawn into the compression chamber, a valve plate formed with an inlet port for guiding the refrigerant from the suction chamber into the compression chamber, and an inlet valve for opening and closing the refrigerant inlet port.

The cylinder head is fixed to one end face of the cylinder block

FIG. 8 is a fragmentary expanded plan view of a valve plate of the conventional reciprocating refrigerant compressor.

The valve plate 402 is arranged between the cylinder head and the cylinder block, while the inlet valve 470 is arranged between the valve plate 402 and the cylinder block.

When the piston is moved from a top dead center position to a bottom dead center position, the inlet valve 470 opens into the cylinder bore 406, whereby the refrigerant flows from the suction chamber into the compression chamber via the inlet port 460.

When the piston is moved from the bottom dead center position to the top dead center position, the refrigerant inlet valve 470 is closed and the refrigerant is compressed within the compression chamber.

However, the cross-sectional area of the inlet port 460 is smaller than the cross-sectional area of the suction chamber, and therefore, when the piston is moved from the top dead center position to the bottom dead center position as described above, the flow of the refrigerant gas from the suction chamber is restricted at the inlet port 460, which prevents smooth flow of the gas into the compression chamber.

Further, since the cross-sectional area of the inlet port 460 is small and the load of the refrigerant gas acting on the inlet valve 470 is low when it is opened, the inlet valve 470 is delayed in timing of opening, and bursts open, which in combination with resilient physical properties of the inlet valve 470 causes self-induced vibration of the valve 470 This vibration produces a pulsation of the suctioned gas to cause resonance in an evaporator, thereby producing noise.

To improve the suction efficiency of the refrigerant gas, and suppress the self-excited vibration of the inlet valve 470, it is only required to increase the size of the inlet port 460 or the number of holes of the inlet port 460.

However, if the size of the inlet port 460 is increased, when the piston is moved from the bottom dead center position to the top dead center position as described above, the pressure of the refrigerant gas in the compression chamber acts on the inlet valve 470, and the pressure acting on this occasion can cause deformation or breakage of the inlet valve 470.

Further, to increase the number of holes of the inlet ports 460, additional space is necessary for the provision of additional holes, and at the same time, the inlet valve is increased in size and weight, which lowers the natural frequency of the inlet valve 470 to sometimes cause resonance of the same.

An object of the invention is to provide a reciprocating refrigerant compressor which is capable of preventing deformation and breakage of an inlet valve and resonance of the inlet valve when refrigerant is compressed, and at the same time, realizing improvement of the suction efficiency of the refrigerant and suppression of self-excited vibration of the inlet valve when the refrigerant is suctioned.

DISCLOSURE OF THE INVENTION

To attain the above object, according to a reciprocating refrigerant compressor of the present invention, in a reciprocating refrigerant compressor including a cylinder block having a cylinder bore, a compression chamber defined within the cylinder bore, a cylinder head that has a low-pressure chamber formed therein for receiving refrigerant gas to be drawn into the compression chamber, and is coupled to one end face of the cylinder block, a valve plate that is arranged between the compression chamber and the low-pressure chamber, and is formed with an inlet port for guiding the refrigerant from the low-pressure chamber into the compression chamber, and an inlet valve for opening and closing the inlet port, wherein the inlet valve has an end whose shape is adapted to a shape of the inlet port, the shape of the inlet port is non-circular, and a portion of an opening edge of the inlet port protrudes into the inside of the inlet port, with tangential lines drawn from the protruding portion intersecting with the opening edge of the inlet port at least two points, and a center of an inscribed circle of the inlet port is located on a center line of the inlet valve.

As described above, the shape of the inlet port is non-circular, and a portion of an opening edge of the inlet port protrudes into the inside of the inlet port, with tangential lines drawn from the protruding portion intersecting with the opening end of the inlet port at least two points. Therefore, the refrigerant becomes easy to flow into the compression chamber, and when the refrigerant within the compression chamber is compressed, the inlet valve is supported by the periphery of the inlet port. Further, when the inlet port is opened, the area receiving pressure is large, which increases load of the refrigerant acting on the inlet valve, so that the timing of opening of the inlet valve is not delayed. Therefore, it is possible to prevent deformation or breakage of the inlet valve and resonance of the inlet valve when the refrigerant is compressed, and at the same time, realize the improvement of suction efficiency and suppression of self-excited vibration of the inlet valve, when the refrigerant is drawn in. Further, since a center of an inscribed circle of the inlet port is located on a center line of the inlet valve, when the inlet valve is opened, the inlet valve is hard to be twisted. This makes the inlet valve less prone to being twisted.

According to a reciprocating refrigerant compressor of the present invention, in a reciprocating refrigerant compressor including a cylinder block having a cylinder bore, a compression chamber defined within the cylinder bore, a cylinder head that has a low-pressure chamber formed therein for receiving refrigerant gas to be drawn into the compression chamber, and is coupled to one end face of the cylinder block, a valve plate that is arranged between the compression chamber and the low-pressure chamber, and is formed with an inlet port for guiding the refrigerant from the low-pressure chamber into the compression chamber, and an inlet valve for opening and closing the inlet port, wherein the inlet valve has an end whose shape is adapted to a shape of the inlet port, the shape of the inlet port is non-circular, and at least two portions of a periphery of the inlet port touch an inscribed circle, with a maximum diameter of the inlet port being larger than a diameter of the inscribed circle of the inlet port, and a center of the inscribed circle of the inlet port is located on a center line of the inlet valve.

As described above, the shape of the inlet port is non-circular, and at least two portions of a periphery of the inlet port touch an inscribed circle, with a maximum diameter of the inlet port being larger than a diameter of the inscribed circle of the inlet port. Therefore, the refrigerant becomes easy to flow into the compression chamber, and when the refrigerant within the compression chamber is compressed, the inlet valve is supported by the periphery of the inlet port. Further, when the inlet port is opened, the area receiving pressure is large, which increases load of the refrigerant acting on the inlet valve, so that the timing of opening of the inlet valve is not delayed. Therefore, it is possible to prevent deformation or breakage of the inlet valve and resonance of the inlet valve when the refrigerant is compressed, and at the same time, realize the improvement of suction efficiency and suppression of self-excited vibration of the inlet valve, when the refrigerant is drawn in. Further, since a center of the inscribed circle of the inlet port is located on a center line of the inlet valve, when the inlet valve is opened, the inlet valve is hard to be twisted. This makes the inlet valve less prone to being twisted.

According to a reciprocating refrigerant compressor of the present invention, in a reciprocating refrigerant compressor including a cylinder block having a cylinder bore, a compression chamber defined within the cylinder bore, a cylinder head that has a low-pressure chamber formed therein for receiving refrigerant gas to be drawn into the compression chamber, and is coupled to one end face of the cylinder block, a valve plate that is arranged between the compression chamber and the low-pressure chamber, and is formed with an inlet port for guiding the refrigerant from the low-pressure chamber into the compression chamber, and an inlet valve for opening and closing the inlet port, wherein the inlet valve has an end whose shape is adapted to a shape of the inlet port, the shape of the inlet port is non-circular, and at least two portions of the inlet port extend radially outward off an inscribed circle of the inlet port, and a center of the inscribed circle of the inlet port is located on a center line of the inlet valve.

As described above, the shape of the inlet port is non-circular, and at least two portions of the inlet port extend radially outward off an inscribed circle of the inlet port. Therefore, the refrigerant becomes easy to flow into the compression chamber, and when the refrigerant within the compression chamber is compressed, the inlet valve is supported by the periphery of the inlet port. Further, when the inlet port is opened, the area receiving pressure is large, which increases load of the refrigerant acting on the inlet valve, so that the timing of opening of the inlet valve is not delayed. Therefore, it is possible to prevent deformation or breakage of the inlet valve and resonance of the inlet valve when the refrigerant is compressed, and at the same time, realize the improvement of suction efficiency and suppression of self-excited vibration of the inlet valve, when the refrigerant is drawn in. Further, since a center of the inscribed circle of the inlet port is located on a center line of the inlet valve, when the inlet valve is opened, the inlet valve is hard to be twisted. This makes the inlet valve less prone to being twisted.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance.

As described above, the inlet port has a portion close to an inner peripheral surface of the cylinder bore, and opposite end portions of the inlet port in a circumferential direction of the valve plate are spaced from the inner peripheral surface of the cylinder bore by a predetermined distance. Therefore, the opposite end portions of the end of the inlet valve in the circumferential direction of the valve plate are spaced from the inner peripheral surface of the cylinder bore by the predetermined distance. This allows the refrigerant to flow between the opposite end portions of the end of the inlet valve in the circumferential direction of the valve plate and the inner peripheral surface of the cylinder bore when the refrigerant flows into the compression chamber. This makes it easier for the refrigerant to flow into the compression chamber. Further, since the center of the inscribed circle of the inlet port is located on the center line of the inlet valve, when the inlet valve is opened, the inlet valve is hard to be twisted. This makes the inlet valve less prone to being twisted.

Preferably, the inlet port is provided, at a rate of at least one inlet port per the compression chamber.

As described above, since the inlet port is provided, at a rate of at least one inlet port per the compression chamber, the amount of refrigerant flowing into the compression chamber is increased. Therefore, the charging efficiency of refrigerant is enhanced. Further, since the center of the inscribed circle of the inlet port is located on the center line of the inlet valve, when the inlet valve is opened, the inlet valve is hard to be twisted. This makes the inlet valve less prone to being twisted.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber.

Preferably, a diameter of the inlet port perpendicular to a radial direction of the valve plate is larger than a diameter of the inscribed circle.

As described above, since a diameter of the inlet port perpendicular to the radial direction of the valve plate is larger than a diameter of an inscribed circle, the flow rate of refrigerant flowing in is increased.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a diameter of the inlet port perpendicular to a radial direction of the valve plate being larger than a diameter of the inscribed circle.

Preferably, the inlet port is provided, at a rate of at least one inlet port per the compression chamber, and a diameter of the inlet port perpendicular to a radial direction of the valve plate is larger than a diameter of the inscribed circle.

Preferably, a center of an inscribed circle of the inlet port is located on a center line of the inlet valve, and a diameter of the inlet port perpendicular to a radial direction of the valve plate is larger than a diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber, and a diameter of the inlet port perpendicular to a radial direction of the valve plate being larger than a diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a center of an inscribed circle of the inlet port being located on a center line of the inlet valve, and a diameter of the inlet port perpendicular to a radial direction of the valve plate being larger than the diameter of the inscribed circle.

Preferably, the inlet port is provided, at a rate of at least one inlet port per the compression chamber, and a center of an inscribed circle of the inlet port is located on a center line of the inlet valve, a diameter of the inlet port perpendicular to a radial direction of the valve plate being larger than a diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber, a center of an inscribed circle of the inlet port being located on a center line of the inlet valve, and a diameter of the inlet port perpendicular to a radial direction of the valve plate being larger than a diameter of the inscribed circle.

Preferably, a diameter of the inlet port in a radial direction of the valve plate is larger than a diameter of the inscribed circle.

As described above, since a diameter of a radial direction of the valve plate is larger than a diameter of the inscribed circle, the flow rate of refrigerant flowing in is increased.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a diameter of the inlet port in a radial direction of the valve plate being larger than the diameter of the inscribed circle.

Preferably, the inlet port is provided, at rate of at least one inlet port par the compression chamber, and a diameter of the inlet port in a radial direction of the valve plate is larger than a diameter of the inscribed circle.

Preferably, a center of an inscribed circle of the inlet port is located on a center line of the inlet valve, and a diameter of the inlet port in a radial direction of the valve plate is larger than a diameter of the inscribed circle.

Preferably, a diameter of the inlet port perpendicular to a radial direction of the valve plate is larger than a diameter of the inscribed circle, and a diameter of the inlet port in the radial direction of the valve plate is larger than the diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber, and a diameter of the inlet port in a radial direction of the valve plate being larger than a diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a center of an inscribed circle of the inlet port being located on a center line of the inlet valve, and a diameter of the inlet port in a radial direction of the valve plate being larger than a diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a diameter of the inlet port perpendicular to a radial direction of the valve plate being larger than a diameter of the inscribed circle, and a diameter of the inlet port in a radial direction of the valve plate being larger than the diameter of the inscribed circle.

Preferably, the inlet port is provided, at a rate of at least one inlet port per the compression chamber, and a center of an inscribed circle of the inlet port is located on a center line of the inlet valve, a diameter of the inlet port in a radial direction of the valve plate being larger than a diameter of the inscribed circle.

Preferably, the inlet port is provided, at a rate of at least one inlet port per the compression chamber, and a diameter of an inlet port perpendicular to the radial direction of the valve plate is larger than a diameter of the inscribed circle, a diameter of the radial direction of the valve plate being larger than the diameter of the inscribed circle.

Preferably, a center of an inscribed circle of the inlet port is located on a center line of the inlet valve, and a diameter of the inlet port perpendicular to a radial direction of the valve plate is larger than a diameter of the inscribed circle, a diameter of the inlet port in the radial direction of the valve plate being larger than the diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per compression chamber, a center of an inscribed circle of the inlet port being located on a center line of the inlet valve, and a diameter of the inlet port in a radial direction of the valve plate being larger than the diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber, a diameter of the inlet port perpendicular to a radial direction of the valve plate being larger than a diameter of the inscribed circle, and a diameter of the inlet port in the radial direction of the valve plate being larger than the diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, a center of an inscribed circle of the inlet port being located on a center line of the inlet valve, a diameter of the inlet port perpendicular to a radial direction of the valve plate being larger than a diameter of the inscribed circle, and a diameter of the inlet port in the radial direction of the valve plate being larger than the diameter of the inscribed circle.

Preferably, the inlet port is provided, at a rate of at least one inlet port per the compression chamber, and a center of an inscribed circle of the inlet port is located on a center line of the inlet valve, a diameter of the inlet port perpendicular to a radial direction of the valve plate being larger than a diameter of the inscribed circle, and a diameter of the inlet port in the radial direction of the valve plate being larger than the diameter of the inscribed circle.

Preferably, the inlet port has a portion close to an inner peripheral surface of the cylinder bore, and opposite end portions of the inlet port in a circumferential direction of the valve plate are spaced from the inner peripheral surface of the cylinder bore by a predetermined distance, the inlet port being provided, at a rate of at least one inlet port per the compression chamber, a center of an inscribed circle of the inlet port being located on a center line of the inlet valve, a diameter of the inlet port perpendicular to a radial direction of the valve plate being larger than a diameter of the inscribed circle, and a diameter of the inlet port in the radial direction of the valve plate being larger than the diameter of the inscribed circle.

BEST MODE FOR CARRYING OUT THE INVENTION

The invention will now be described in detail with reference to drawings showing preferred embodiments thereof.

Figure 1:
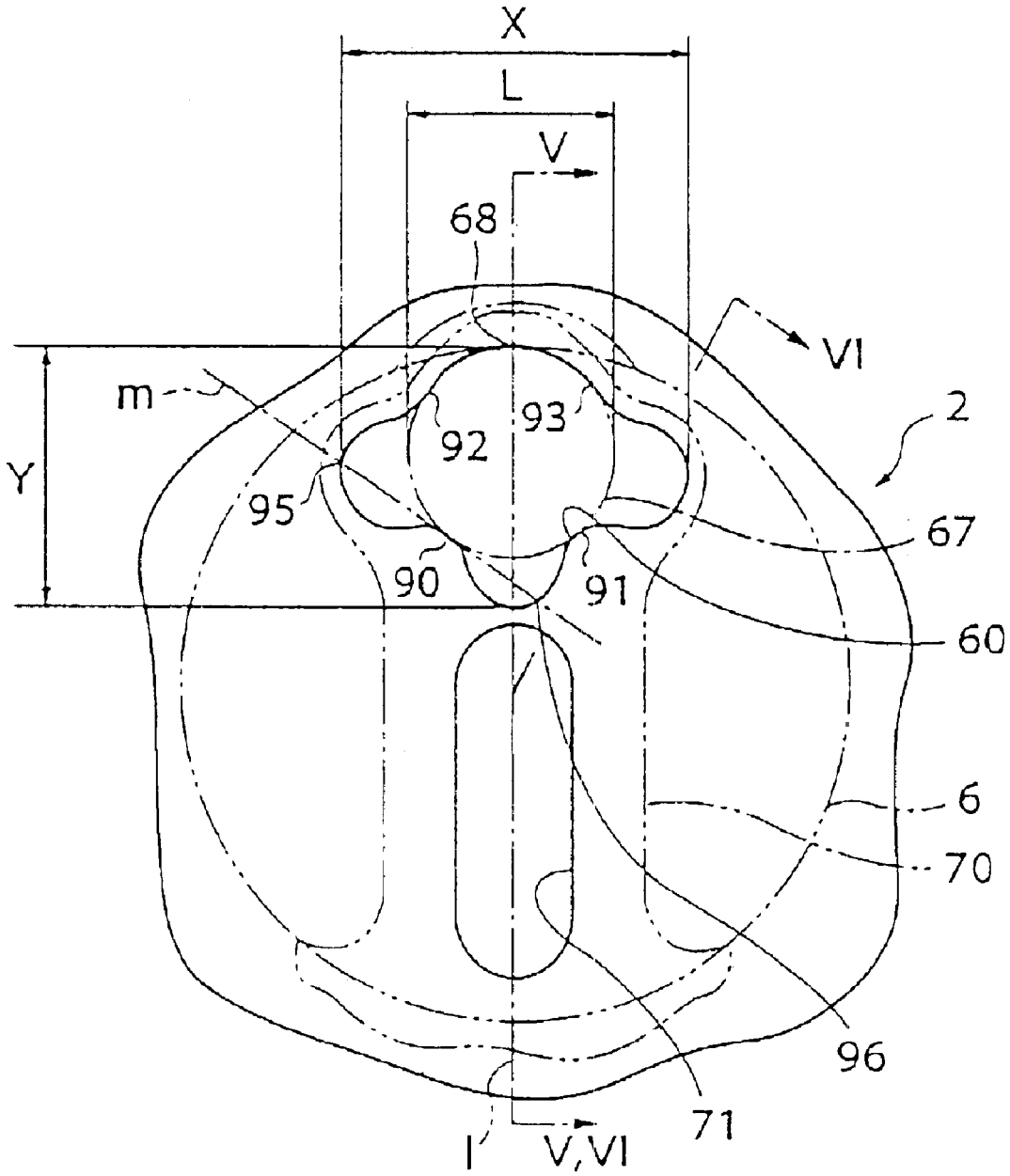
FIG. 1 is an expanded view of part of FIG. 2.
Figure 2:
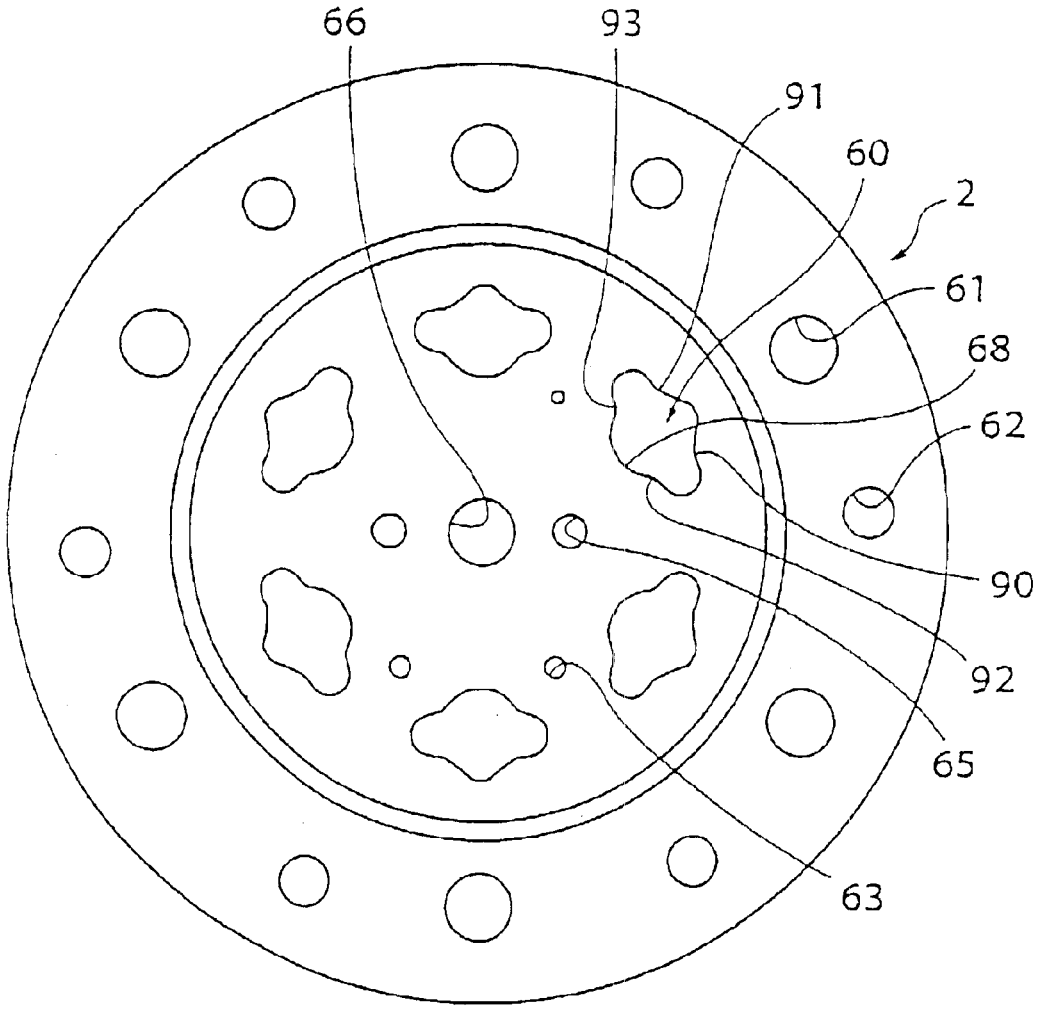
FIG. 2 is a plan view of a valve plate.
Figure 3:
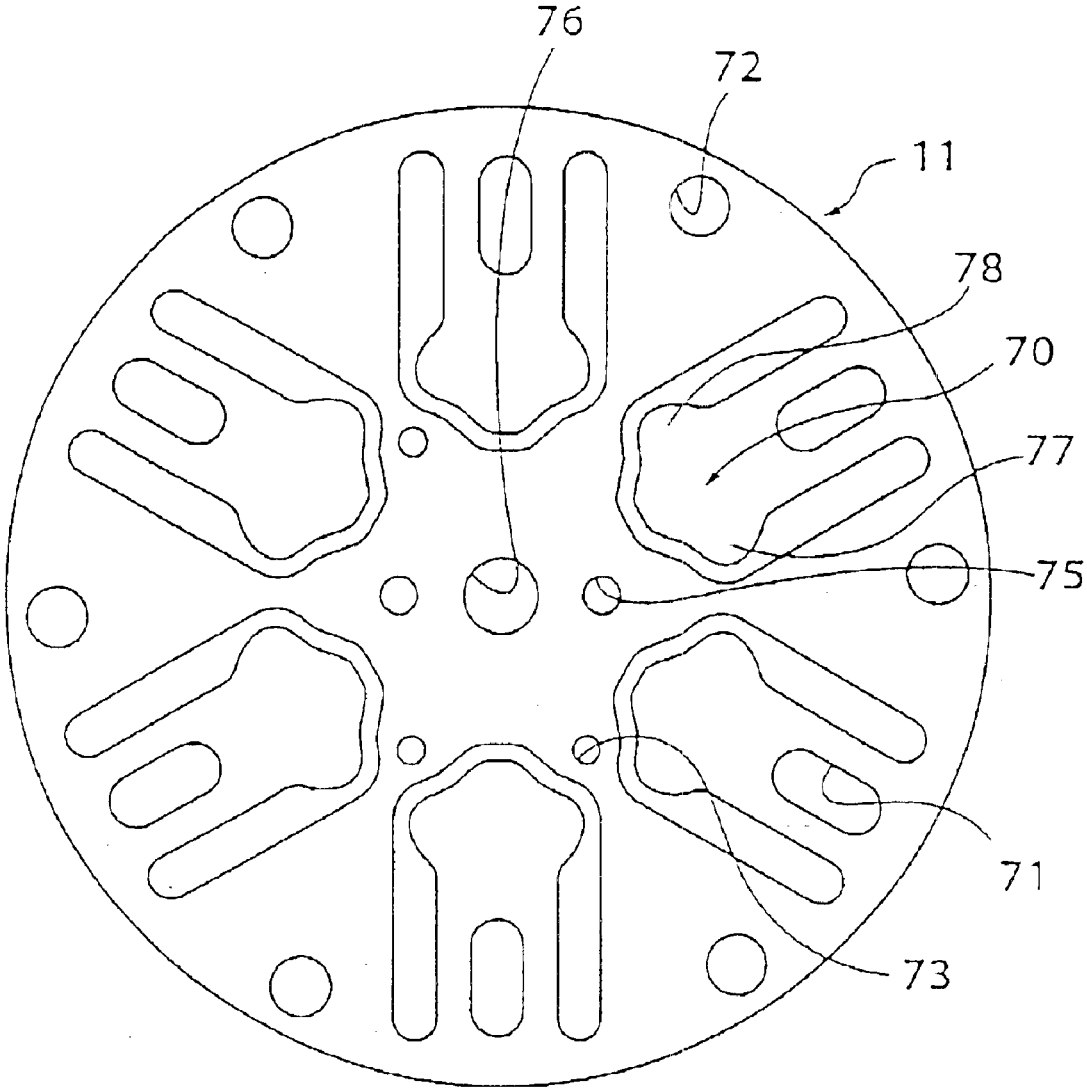
FIG. 3 is a plan view of a valve sheet.
Figure 4:
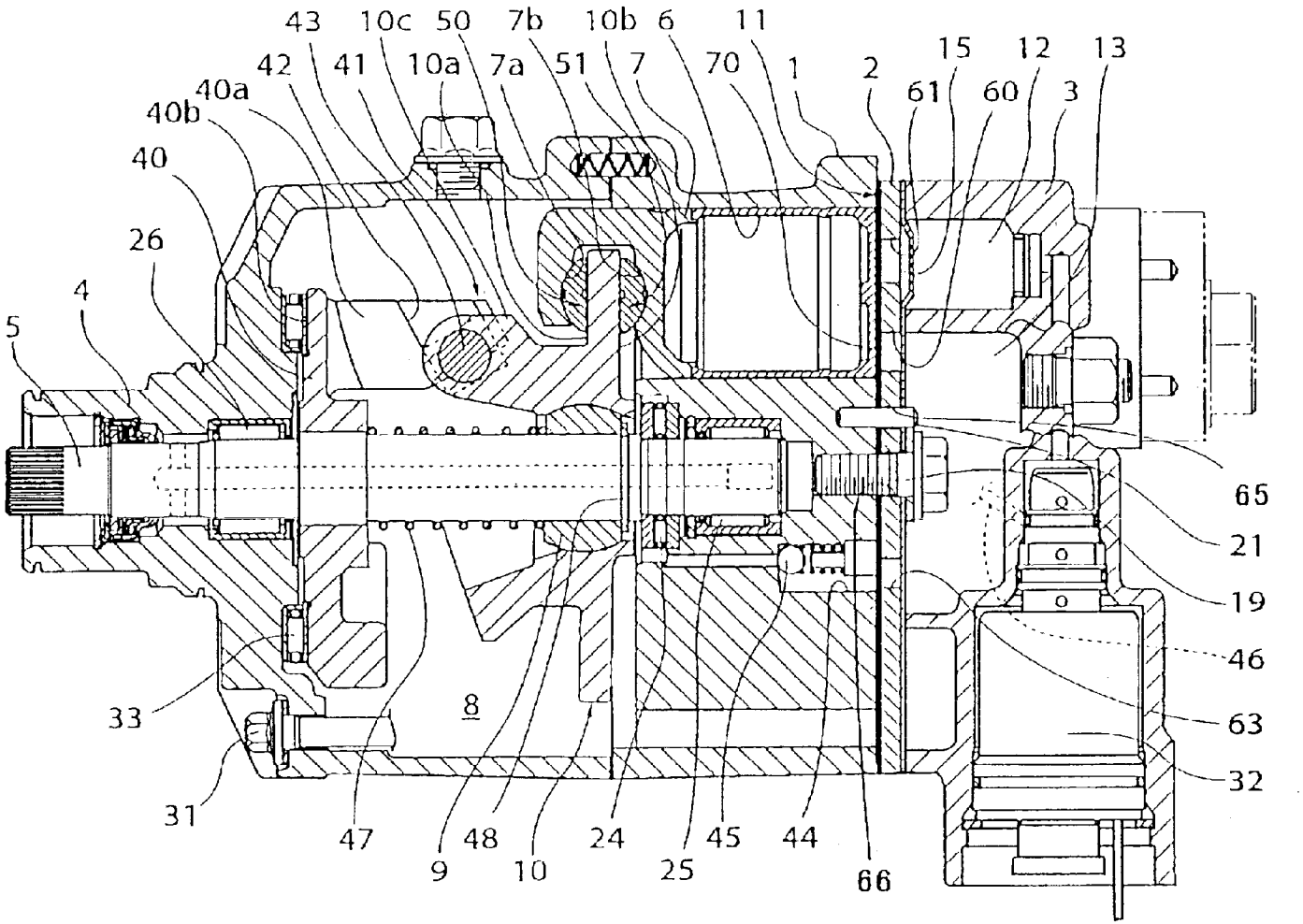
FIG. 4 is a longitudinal cross-sectional view of a variable capacity swash plate compressor according to an embodiment of the invention.
Figure 5:
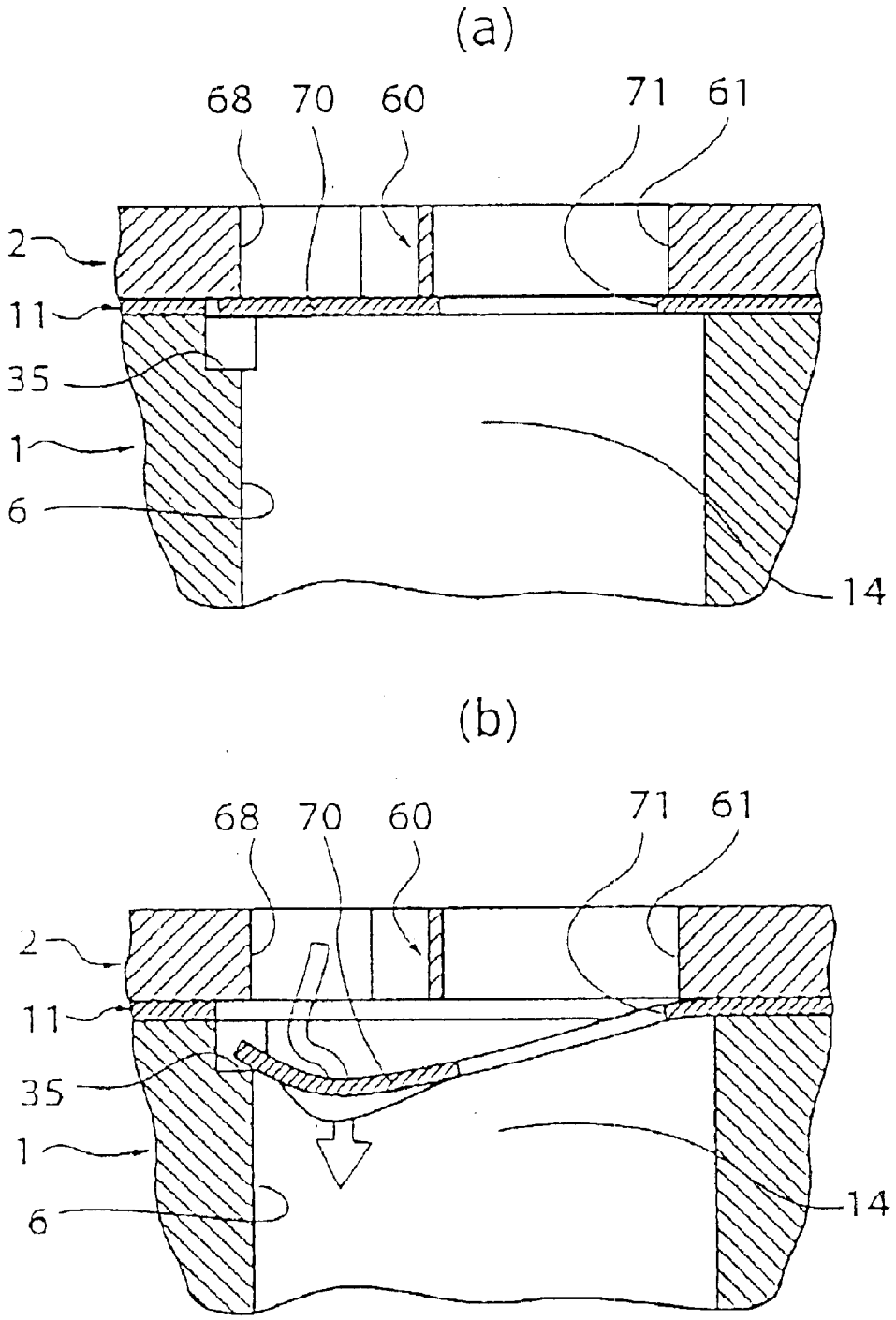
FIG. 5 provide cross-sectional views taken on line V—V of FIG. 1, in which FIG. 5(*a*) is a view showing a closed state of an inlet valve, and FIG. 5(*b*) is a view showing an open state of the same.
Figure 6:
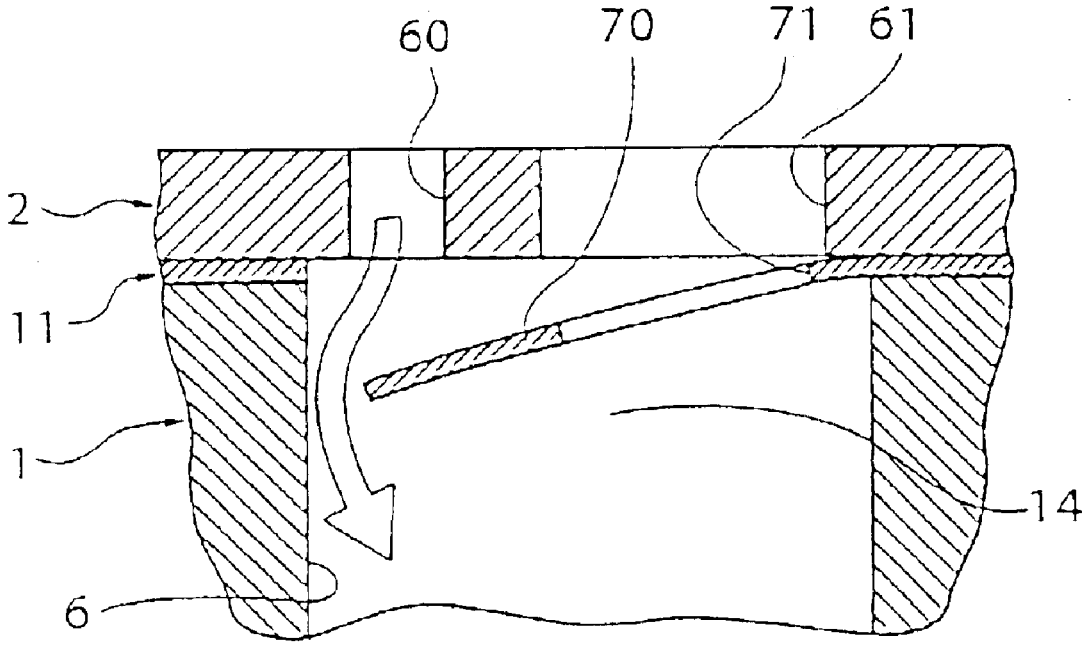
FIG. 6 is a cross-sectional view taken on line VI—VI of FIG. 1.

FIG. 4 shows a variable capacity swash plate compressor according to an embodiment of the invention; FIG. 2 is a plan view of a valve plate; FIG. 3 is a plan view of a valve sheet; FIG. 1 is an expanded view of part of FIG. 2; FIG. 5 provide cross-sectional views taken on line V—V of FIG. 1, in which FIG. 5(*a*) is a view showing a closed state of an inlet valve, and FIG. 5(*b*) is a view showing an open state of the same; and FIG. 6 is a cross-sectional view taken on line VI—VI of FIG. 1.

This variable capacity swash plate compressor has a cylinder block 1 having one end thereof secured to a rear head (cylinder head) 3 via a valve plate 2 and the other end thereof secured to a front head 4.

The cylinder block 1 has a plurality of cylinder bores 6 axially extending therethrough at predetermined circumferential intervals about the shaft 5. Each cylinder bore 6 has a piston 7 slidably received therein. The cylinder bore 6 defines a compression chamber 14 therein, the volume of which is changed with motion of the piston 7.

The thrust flange 40 is rigidly fitted on the shaft 5, for rotation in unison with the same. The thrust flange 40 is rotatably supported on an inner wall of the front head 4 via a thrust bearing 33. The swash plate 10 is fitted on the shaft 5 via a hinge ball 9 such that it is slidable on the shaft 5 and at the same time tiltable about a hinge ball 9 with respect to the shaft 5.

Further, the swash plate 10 is connected to the thrust flange 40 via a linkage 41, referred to hereinafter, for rotation in unison with the thrust flange 40 as the thrust flange 40 rotates. The swash plate 10 can tilt with respect to an imaginary plane perpendicular to the shaft 5. The swash plate 10 is coupled to concave portions 7*a*, 7*b* of the piston 7 via shoes 50, 51. The shoes 50, 51 perform relative rotation on respective sliding surfaces 10*a*, 10*b* of the swash plate 10 as the shaft 5 rotates.

The shaft 5 has one end thereof rotatably supported via a radial bearing 26 by the front head 4 and the other end thereof rotatably supported via a radial bearing 25 and a thrust bearing 24 by the cylinder block 1.

The linkage 41 is comprised of a guide groove 42 formed in a protruding portion 40*a* of the thrust flange 40, and a pin 43 fixed to an arm 10*c* of the swash plate 10. The longitudinal axis of the guide groove 42 is inclined by a predetermined angle with respect to a plane 40*b* where the thrust flange 40 and the thrust bearing 43 are in contact with each other. The pin 43 has an end thereof relatively slidably fitted in the guide groove 42.

A coil spring 47 is fitted between the thrust flange 40 and the swash plate 10, and the urging force of the coil spring 47 urges the swash plate 10 toward the cylinder block 1. A stopper 48 for the hinge ball 9 is fitted between the cylinder block 1 and the hinge ball 9.

Within the rear head 3, there are formed a suction chamber 13 and a discharge chamber 12 located around the discharge chamber 12.

The valve plate 2 is formed with a plurality of outlet ports 61 each for communicating between the cylinder bore 6 and the discharge chamber 12, and a plurality of inlet ports 60 each for communicating between the cylinder bore 6 and the suction chamber 13. The outlet ports 61 and the inlet ports 60 are arranged at predetermined circumferential intervals. Further, the valve plate 2 is formed with holes 66, 62 for inserting bolts 19, 31, a hole 65 for inserting a positioning pin 21 for assembling the valve plate 2 with the cylinder block 1, and a hole 63 forming part of a communication passage 44, referred to hereinafter.

A valve sheet 11 is overlaid to the valve plate 2. As shown in FIG. 3, the valve sheet 11 is integrally formed with a plurality of inlet valves 70 which are formed with a hole 71 for preventing the outlet port 61 from being blocked by the inlet valve 70.

Further, the valve sheet 11 is formed with holes 76, 72, 75, 73 corresponding to the holes 66, 62, 65, 63 of the valve plate 2, respectively.

The outlet ports 61 are opened and closed by the outlet valves 15, and the inlet ports 60 are opened and closed by the inlet valves 70.

The respective numbers of the inlet valves 70, the outlet valves 15, the inlet ports 60, the outlet ports 61, and the compression chambers 14 are equal to the number (6 in this embodiment) of the cylinder bores 6.

The inlet port 60 and the outlet port 61 are located, as shown in FIG. 1, inward of the opening edge of the cylinder bore 6. Further, the inlet ports 60 are located inward of the outlet ports 61 (radially inward in the valve plate 2). The center of an inscribed circle 67 of the inlet port 60 (circle corresponding to an area of a conventional inlet port) is located on a center line 1 of the inlet valve 70. The inlet port 60 is generally rhombus-shaped. The periphery of the inlet port 60 is in contact with the inscribed circle 67 at three points. Part of the opening edge of the inlet port 60 protrudes into the inside of the inlet port 60 to form protruding portions 90, 91, 92, 93, and each tangential line m drawn from these protruding portions 90, 91, 92, 93 intersect with the opening edge of the inlet port 60 at two points (FIG. 1 illustrates only an example of the tangential line from the protruding portion 90 intersecting with the opening edge at points 95, 96).The inlet port 60 has two portions extending off the inscribed circle 67 in directions perpendicular to a radial direction of the valve plate 2, and one portion extending off the inscribed circle 67 in the radial direction of the valve plate 2. A diameter X of the inlet port 60 in the direction perpendicular to the radial direction of the valve plate 2 (maximum diameter of the valve plate 2) and a diameter Y of the inlet port 60 in the radial direction of the value plate 2 are both larger than the diameter L of the inscribed circle 67. The inlet ports 60 are provided, at a rate of one inlet port 60 per compression chamber 14.

The inlet port 60 has a portion 68 close to the inner peripheral surface of the cylinder bore 6, and opposite end portions 77, 78 in the circumferential direction of the inlet port 15 are spaced from the inner peripheral surface of the cylinder bore 6 by a predetermined distance. The inlet valve 70 has an end thereof shaped such that it can block the inlet port 60. Opposite end portions 77, 78 of the end of the inlet valve 70 in the circumferential direction of the valve plate 2 are also spaced from the inner peripheral surface of the cylinder bore 6 by a predetermined distance, similarly to the inlet port 60.

The cylinder block 1 is formed with the communication passage 44 communicating between the suction chamber 13 and the crankcase 8, and a valve 45 is arranged across an intermediate portion of the communication passage 44 for opening and closing the passage 44. Further, a pressure control valve 32 is arranged across an intermediate portion of a communication passage 46 communicating between the discharge chamber 12 and the crankcase 8, for controlling pressure in the discharge chamber 12 and pressure in the crankcase 8.

As shown in FIG. 5(*a*), a stopper recess 35 is formed in a portion of the opening edge of the cylinder bore 6 at a location opposed to the end of the inlet valve 70, for restricting the bend of the inlet value 70 during suction of the refrigerant gas. The stopper recess 35 sets a limit to the amount of bend (opening) of the inlet valve 70.

Next, the operation of this variable capacity swash plate compressor will be described.

As torque of an engine, not shown, installed on an automotive vehicle, not shown, is transmitted to the shaft 5 to rotate the same, the torque of the shaft 5 is transmitted to the swash plate 10 via the thrust flange 40 and the linkage 41 to cause rotation of the swash plate 10. When rotation of the swash plate 10 causes the shoes 50, 51 to perform relative rotation on the respective sliding surfaces 10*a*, 10*b* of the swash plate 10, whereby the torque from the swash plate 10 is converted into the linear reciprocating motion of each piston 7. As the piston 7 slides in the cylinder bore 6, the volume of the compression chamber 14 within the cylinder bore 6 changes, which causes, suction, compression, and delivery of refrigerant gas to be sequentially carried out, whereby high-pressure refrigerant gas is delivered from the swash plate compressor in an amount corresponding to an angle of inclination of the swash plate 10.

When thermal load on the compressor decreases and the pressure control valve 32 is closed to increase the pressure in the crankcase 8, the angle of inclination of the swash plate 10 becomes smaller, so that the length of stroke of the piston 7 is decreased to reduce the delivery quantity or capacity of the compressor. On the other hand, when thermal load on the compressor increases and the pressure control valve 32 opens the communication passage 46 to reduce the pressure in the crankcase 8, the angle of inclination of the swash plate 10 becomes larger, whereby the length of stroke of the piston 7 is increased to decrease the delivery quantity or capacity of the compressor.

In the suction stroke, as the piston moves to the bottom dead center position, the difference between pressure in the compression chamber 14 and pressure in the suction chamber 13 is increased, so that as shown in FIG. 5(*b*), the inlet valve 70 is bent into the compression chamber 14 to open the inlet port 60, via which the refrigerant flows from the suction chamber 13 into the compression chamber 14. At this time, load of the refrigerant acting on the inlet valve 70 is increased, which prevents the opening of the inlet valve 70 from being delayed in timing. Further, since the center of the inscribed circle 67 of the inlet port 60 is positioned on the center line 1 of the inlet valve 70, the inlet valve 70 is hard to twist. When the refrigerant enters the compression chamber 14, the refrigerant flows in with a stream thereof being bent by the inlet valve in a radial direction of the cylinder bore 6.

Since the diameter X of the inlet port 60 in the direction perpendicular to the radial direction of the valve plate (maximum diameter of the inlet port 60) and the diameter Y of the inlet port 60 in the radial direction of the valve plate are larger than the diameter L of the inscribed circle 67, the refrigerant is easy to flow in, resulting in an increased flow rate of the refrigerant.

Further, since the opposite end portions 77, 78 of the end of the inlet valve 70 in the circumferential direction of the valve plate are spaced from the inner peripheral surface of the cylinder bore 6 by the predetermined distance, the refrigerant flows between the opposite end portions 77, 78 in the circumferential direction of the valve plate 2 and the inner peripheral surface of the cylinder bore 6, without having streams thereof being bent much, as shown in FIG. 6.

In the compression stroke, as the piston 7 is moved to the top dead center position, the volume of the compression chamber 14 is progressively reduced to increase the pressure in the compression chamber 14. At this time, the inlet valve 70 is supported by the periphery of the inlet port 60.

In the delivery stroke, the volume of the compression chamber 14 becomes minimum, and the pressure in the compression chamber 14 becomes maximum. When there is produced a predetermined differential pressure between the compression chamber 14 and the discharge chamber 12, the outlet valve 15 is bent into the discharge chamber 12 to open the outlet port 61. At this time, the inlet valve 70 blocks the inlet port 60.

According to this embodiment, the refrigerant becomes easy to flow into the compression chamber 14, and when the refrigerant within the compression chamber 14 is compressed, the inlet valve 70 is supported by the periphery of the inlet port 60. Further, when the refrigerant is suctioned, the timing of opening of the inlet valve 70 is not delayed, which makes it possible to suppress the self-excited vibration of the inlet valve 70 which would be caused by delay in the timing. This makes it unnecessary to simply increase the size of the inlet port 60 or the number of holes of the inlet port 60, and hence possible to prevent deformation or breakage of the inlet valve 70 and resonance of the inlet valve 70 when the refrigerant is compressed, and at the same time, realize the improvement of suction efficiency and suppression of self-excited vibration of the inlet valve 70 when the refrigerant is suctioned.

Further, since the minimum diameter of the inlet port 60 (the shortest straight line passing through the center of the inscribed circle 67; the line connecting between the protruding portion 90 and the protruding portion 93 in the present embodiment) is smaller than that of circular inlet port simply increased in size, the bending moment of the inlet valve 70 occurring when the refrigerant is compressed can be reduced whereby the reliability of the inlet valve 70 is enhanced.

Moreover, the circumferential length of the opening edge of the inlet port 60 becomes longer, which makes it possible to reduce the shearing force produced between the periphery of the inlet port 60 and the inlet valve 70, and thereby enhance the reliability of the inlet valve 70.

Further, the diameter X of the inlet port 60 perpendicular to the radial direction of the valve plate and the diameter Y of the inlet port 60 in the radial direction of the valve plate is larger than the diameter L of the inscribed circle 67, which increases the flow rate of the refrigerant flowing in. This enables the location of the stopper recess 35 to be made closer to the valve plate 2 to thereby further suppress the self-excited vibration without reducing the flow rate of the refrigerant flowing into the compression chamber 14.

Moreover, when the refrigerant flows into the compression chamber 14, the refrigerant flows between the opposite end portions 77, 78 of the end of the inlet valve 70 in the circumferential direction of the valve plate and the inner peripheral surface of the cylinder bore 6 without having a stream thereof bent much, which makes it easier for the refrigerant to flow into the compression chamber 14.

Further, since the center of the inscribed circle 67 of the inlet port 60 is positioned on the center line 1 of the inlet valve 70, when the inlet valve 70 is opened, the inlet valve 70 is hard to be twisted.

Further, since at least one inlet port 60 is provided for each compression chamber 14, the amount of refrigerant flowing into the compression chamber 14 is increased, which enhances charging efficiency of the refrigerant.

Figure 7:
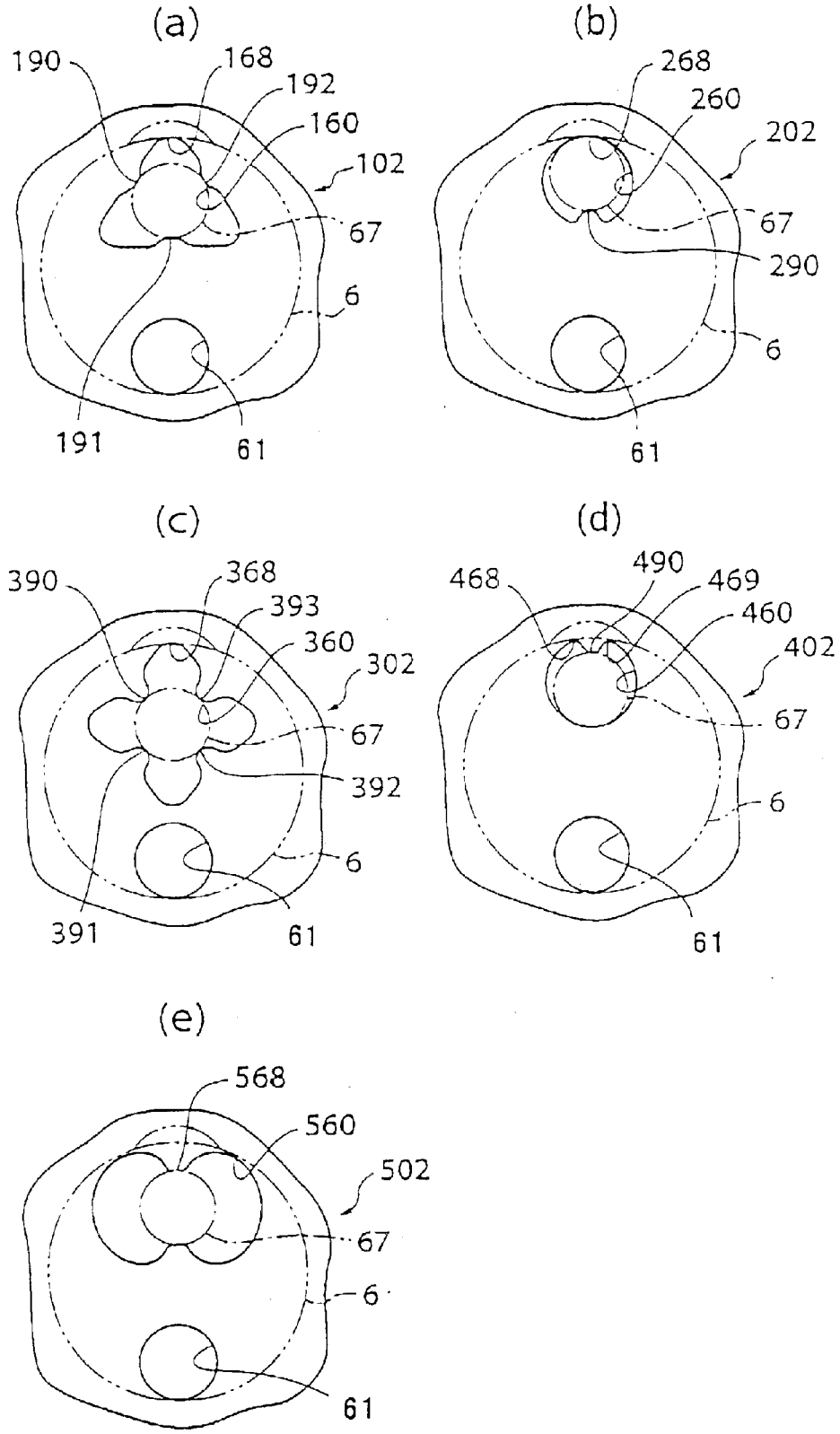
FIGS. 7(*a*) to 7(*e*) are views useful in explaining variations of the inlet port.
Figure 8:
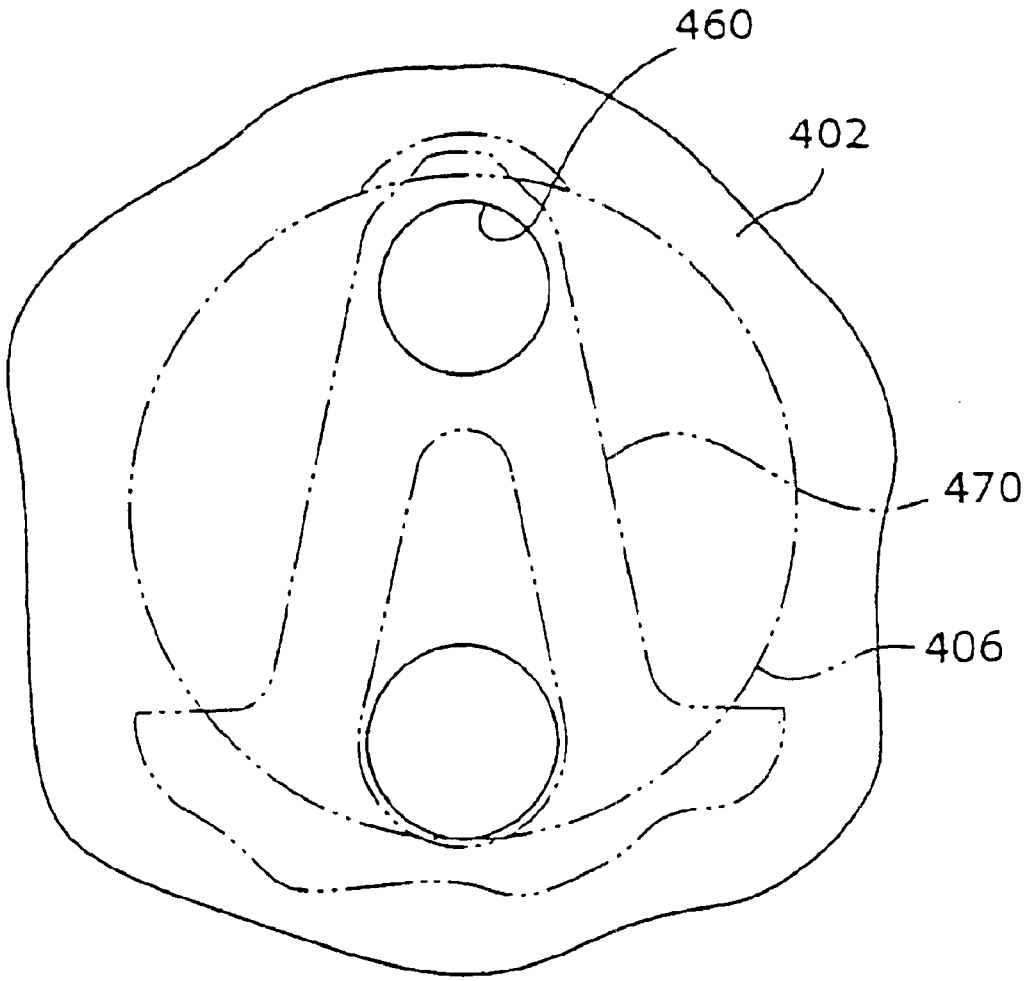
FIG. 8 is an expanded plan view of part of a valve plate of a conventional reciprocating refrigerant compressor.

FIGS. 7(*a*) to 7(*b*) are views showing inlet valves of the valve plate according to variations of the present embodiment.

In a valve plate 102 shown in FIG. 7(*a*) variation, an inlet port 160 has three portions expanded in respective directions of approximately 0 degrees, 120 degrees, and 240 degrees around the inscribed circle 67 with respect to a predetermined location 168 of the inlet port 60.

The opening edge of the inlet port 160 is formed with protruding portions 190, 191, 192.

In a valve plate 202 shown in FIG. 7(*b*) variation, an inlet port 260 has two portions thereof expanded toward the outlet port 61.

The opening edge of the inlet port 260 is formed with a protruding portion 290.

In a valve plate 302 shown in FIG. 7(*c*) variation, an inlet port 360 has four portions expanded in respective directions of approximately 0 degrees, 90 degrees, 180 degrees, and 270 degrees around the inscribed circle 67 with respect to a predetermined location 368 of the inlet port 360.

The opening edge of the inlet port 360 is formed with protruding portions 390, 391, 392, 393.

In a valve plate 402 shown in FIG. 7(*d*) variation, the inlet port in FIG. 7(*b*) is rotated through approximately 180 degrees, whereby portions 468, 469 of the inlet port are made closer to the inner peripheral surface of the cylinder bore 6.

The opening edge of the inlet port 460 is formed with a protruding portion 490.

According to these variations, the same advantageous effects as provided by the above embodiment can be obtained.

It should be noted that in the above embodiment, although the description is given of cases in which the diameter X of the inlet ports 60, 160, 260, 360, 460 in the direction perpendicular to the radial direction of the valve plate and the diameter Y in the radial direction of the valve plate are larger than the diameter L of the inscribed circle 67, the scope of application of the present invention is not limited to this, but the invention can be applied to compressors so long as they have a maximum diameter of an inlet port larger than the diameter of the inscribed circle. Further, two or more inlet ports 60 may be provided for each compression chamber 14.

Further, although in the above embodiment, the description is given of cases where the inlet ports 60, 160. 260, 360, 460 are made closer to the opening edge of the cylinder bore 6, this is not limitative, but as in the case of the FIG. 7(*e*) variation, an inlet port 560 may be made remoter from the opening edge of the cylinder bore 6. In this variation, the inlet port 560 has two portions thereof expanded in respective directions of approximately 0 degrees, 90 degrees, and 270 degrees around the inscribed circle 67 with respect to a predetermined location 568 of the inlet port 560.

Further, although in the above embodiment, the variable capacity swash plate compressor is described as an example of the reciprocating refrigerant compressor, this is not limitative, but the present invention can be applied to other reciprocating refrigerant compressors, such as fixed capacity compressors and wobble plate compressors.

INDUSTRIAL APPLICABILITY

As described heretofore, the reciprocating refrigerant compressor according to the present invention is useful for a refrigerant compressor of an air conditioner, particularly an automotive air conditioner, and a refrigerant compressor of a refrigeration system, and particularly suitable for suppressing noise.

What is claimed is:

1. A reciprocating refrigerant compressor comprising:

a cylinder block having a cylinder bore, a compression chamber within the cylinder bore, a cylinder head which includes a low-pressure chamber formed therein for receiving refrigerant gas to be drawn into the compression chamber, and which is coupled to one end face of the cylinder block, a valve plate which is arranged between the compression chamber and the low-pressure chamber, and which includes an inlet port for guiding the refrigerant from the low-pressure chamber into the compression chamber, and an inlet valve having an end for opening and closing the inlet port, wherein the end of the inlet valve has a shape which corresponds to a shape of the inlet port, wherein the shape of the inlet port is non-circular, at least two portions of a periphery of the inlet port touch an inscribed circle, and a maximum diameter of the inlet port is larger than a diameter of the inscribed circle of the inlet port, wherein a center of the inscribed circle of the inlet port is located on a center line of the inlet valve, and wherein a length of the inlet port in a direction perpendicular to the center line of the inlet valve is longer than a length of the inlet port in a direction along the center line of the inlet valve.

2. A reciprocating refrigerant compressor according to claim 1, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance.

3. A reciprocating refrigerant compressor according to claim 1, wherein at least one said inlet port is provided for each said compression chamber.

4. A reciprocating refrigerant compressor according to claim 1, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance, and wherein at least one said inlet port is provided for each said compression chamber.

5. A reciprocating refrigerant compressor according to claim 1, wherein a diameter of the inlet port perpendicular to a radial direction of the valve plate is larger than a diameter of the inscribed circle.

6. A reciprocating refrigerant compressor according to claim 1, wherein a diameter of the inlet port in a radial direction of the valve plate is larger than a diameter of the inscribed circle.

7. A reciprocating refrigerant compressor comprising:

a cylinder block having a cylinder bore, a compression chamber within the cylinder bore, a cylinder head which includes a low-pressure chamber formed therein for receiving refrigerant gas to be drawn into the compression chamber, and which is coupled to one end face of the cylinder block, a valve plate which is arranged between the compression chamber and the low-pressure chamber, and which includes an inlet port for guiding the refrigerant from the low-pressure chamber into the compression chamber, and an inlet valve for opening and closing the inlet port, wherein the inlet valve has an end with a shape which corresponds to a shape of the inlet port, wherein the shape of the inlet port is non-circular, and a portion of an opening edge of the inlet port protrudes inward such that tangential lines drawn from the protruding portion intersect the opening edge of the inlet port at at least two points, wherein a center of an inscribed circle of the inlet port is located on a center line of the inlet valve, and wherein a length of the inlet port in a direction perpendicular to the center line of the inlet valve is longer than a length of the inlet port in a direction along the center line of the inlet valve.

8. A reciprocating refrigerant compressor according to claim 7, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance.

9. A reciprocating refrigerant compressor according to claim 7, wherein at least one said inlet port is provided for each said compression chamber.

10. A reciprocating refrigerant compressor according to claim 7, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance, and wherein at least one said inlet port is provided for each said compression chamber.

11. A reciprocating refrigerant compressor according to claim 7, wherein a diameter of the inlet port perpendicular to a radial direction of the valve plate is larger than a diameter of the inscribed circle.

12. A reciprocating refrigerant compressor according to claim 7, wherein a diameter of the inlet port in a radial direction of the valve plate is larger than a diameter of the inscribed circle.

13. A reciprocating refrigerant compressor comprising:

a cylinder block having a cylinder bore, a compression chamber within the cylinder bore, a cylinder head which includes a low-pressure chamber formed therein for receiving refrigerant gas to be drawn into the compression chamber, and which is coupled to one end face of the cylinder block, a valve plate which is arranged between the compression chamber and the low-pressure chamber, and which includes an inlet port for guiding the refrigerant from the low-pressure chamber into the compression chamber, and an inlet valve for opening and closing the inlet port, wherein the inlet valve has an end with a shape which corresponds to a shape of the inlet port, wherein the shape of the inlet port is non-circular, and at least two portions of the inlet port extend radially outward off an inscribed circle of the inlet port, wherein a center of the inscribed circle of the inlet port is located on a center line of the inlet valve, and wherein a length of the inlet port in a direction perpendicular to the center line of the inlet valve is longer than a length of the inlet Port in a direction along the center line of the inlet valve.

14. A reciprocating refrigerant compressor according to claim 13, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance.

15. A reciprocating refrigerant compressor according to claim 13, wherein at least one said inlet port is provided for each said compression chamber.

16. A reciprocating refrigerant compressor according to claim 13, wherein the inlet port has a portion close to an inner peripheral surface of the cylinder bore, and opposite end portions of the inlet port in a circumferential direction of the valve plate are spaced from the inner peripheral surface of the cylinder bore by a predetermined distance, and wherein at least one said inlet port is provided for each said compression chamber.

17. A reciprocating refrigerant compressor according to claim 13, wherein a diameter of the inlet port perpendicular to a radial direction of the valve plate is larger than a diameter of the inscribed circle.

18. A reciprocating refrigerant compressor according to claim 13, wherein a diameter of the inlet port in a radial direction of the valve plate is larger than a diameter of the inscribed circle.

* * * * *